US008947466B2

(12) United States Patent
Yoon et al.

(10) Patent No.: US 8,947,466 B2
(45) Date of Patent: Feb. 3, 2015

(54) DISPLAY PANEL, METHOD FOR DRIVING THE DISPLAY PANEL, AND DISPLAY APPARATUS FOR PERFORMING THE METHOD

(75) Inventors: Seon-Tae Yoon, Seoul (KR); Ki-Soo Park, Seoul (KR); Jae-Byung Park, Seoul (KR); Mun-Ki Sim, Cheongju-si (KR)

(73) Assignee: Samsung Display Co., Ltd., Yongin (KR)

( * ) Notice: Subject to any disclaimer, the term of this patent is extended or adjusted under 35 U.S.C. 154(b) by 610 days.

(21) Appl. No.: 13/010,735

(22) Filed: Jan. 20, 2011

(65) Prior Publication Data

US 2012/0026205 A1 Feb. 2, 2012

(30) Foreign Application Priority Data

Jul. 30, 2010 (KR) ..... 10-2010-0073951

(51) Int. Cl.
*G09G 5/10* (2006.01)
*G09G 3/34* (2006.01)

(52) U.S. Cl.
CPC ..... *G09G 3/346* (2013.01); *G03G 2300/0809* (2013.01); *G09G 2310/0262* (2013.01)
USPC ..... 345/690

(58) Field of Classification Search
USPC ..... 345/690
See application file for complete search history.

(56) References Cited

U.S. PATENT DOCUMENTS

| | | | | |
|---|---|---|---|---|
| 2007/0086078 | A1* | 4/2007 | Hagood et al. | 359/298 |
| 2007/0195026 | A1 | 8/2007 | Hagood et al. | |
| 2007/0247419 | A1* | 10/2007 | Sampsell | 345/108 |
| 2008/0129681 | A1 | 6/2008 | Hagood et al. | |
| 2008/0174532 | A1 | 7/2008 | Lewis | |

* cited by examiner

*Primary Examiner* — Van Chow
(74) *Attorney, Agent, or Firm* — H.C. Park & Associates, PLC

(57) ABSTRACT

A display panel includes first and second substrates. The first substrate includes a light blocking layer having an opening through the light blocking layer. The opening is arranged in a pixel area. The second substrate includes first and second transistors, first and second driving electrodes, and a shutter. The first transistor is turned on in response to a low level control voltage. The second transistor is electrically connected to the first transistor and is turned on in response to receiving a low level voltage from the first transistor. The first driving electrode is electrically connected to the first transistor, and the second driving electrode is electrically connected to the second transistor. The shutter exposes or covers the opening by moving to the first driving electrode or the second driving electrode according to the relative levels of voltages applied to the first and second driving electrodes.

24 Claims, 7 Drawing Sheets

DISPLAY PANEL, METHOD FOR DRIVING THE DISPLAY PANEL, AND DISPLAY APPARATUS FOR PERFORMING THE METHOD

CROSS REFERENCE TO RELATED APPLICATION

This application claims priority from and the benefit of Korean Patent Application No. 10-2010-0073951, filed on Jul. 30, 2010, which is hereby incorporated by reference for all purposes as if fully set forth herein.

BACKGROUND

1. Technical Field

Exemplary embodiments of the present invention relate to a display panel, a method for driving the display panel, and a display apparatus for performing the method. More particularly, the present invention relates to a display panel to control light using a mechanically operated shutter, a method for driving the display panel, and a display apparatus to perform the method.

2. Discussion of the Background

Generally, a cathode-ray tube (CRT), a liquid crystal display (LCD), a plasma display panel (PDP), and a field emission display (FED) may be used as a display apparatus to display and compile input data.

New modes for operating the display apparatus have been studied recently. For example, an organic light emitting display (OLED) is a potential next generation display apparatus with respect to the LCD, the PDP, and the CRT. Recently, a display apparatus based on a micro electro-mechanical system (MEMS) has gained attention. When the MEMS-based display is used for the display apparatus, light usage efficiency may be enhanced and switching speed may be increased.

The MEMS-based display apparatus may include a first substrate and a second substrate. The first substrate may include a light blocking layer having at least one opening formed through the light blocking layer. The second substrate includes a shutter assembly, and the shutter assembly includes a digital micro shutter (DMS) having at least one opening formed through the DMS. In a MEMS-based display apparatus, light emitted from a light source may be blocked or transmitted according to the position of the DMS relative to a light blocking layer. The DMS horizontally moves substantially parallel with the second substrate to align the opening of the light blocking layer with the opening of the DMS or to misalign the opening of the light blocking layer with the opening of the DMS. For example, when the opening of the light blocking layer and the opening of the DMS are aligned, light is transmitted. However, when the opening of the light blocking layer and the opening of the DMS are misaligned, light is blocked.

However, a plurality of signal lines and a plurality of switching elements are necessary to horizontally move the DMS. Thus, a large number of signal lines and switching elements is typically required, which decreases the aperture ratio of the display apparatus.

SUMMARY OF THE INVENTION

Exemplary embodiments of the present invention provide a display panel that may enhance the aperture ratio using a simple structure.

Additional features of the invention will be set forth in the description that follows and, in part, will be apparent from the description or may be learned by practice of the invention.

An exemplary embodiment of the present invention discloses a display panel that comprises a first substrate comprising a light blocking layer. The light blocking layer comprises an opening through the light blocking layer, and the opening being arranged in a pixel area. The display panel also comprises a second substrate opposing the first substrate and comprising a first transistor, a second transistor, a first driving electrode, a second driving electrode, and a shutter. The first transistor turns on in response to a gate signal having a low level, and the second transistor is electrically connected to the first transistor and turns on in response to a data signal having a low level. The first driving electrode is electrically connected to the first transistor, and the second driving electrode is electrically connected to the second transistor. The shutter exposes or covers the opening by moving to the first driving electrode or the second driving electrode according to the relative levels of voltages applied to the first driving electrode and the second driving electrode.

An exemplary embodiment of the present invention also discloses a method for driving a display panel. The method comprises applying a data signal having a high level to the first driving electrode through a first transistor, the first transistor being turned on in response to a gate signal having a low level; turning off a second transistor in response to the data signal having a high level and the first transistor in response to the gate signal having a high level, the second transistor being electrically connected to the second driving electrode; and moving the shutter to the first driving electrode to transmit the light An exemplary embodiment of the present invention additionally discloses a display apparatus that comprises a light source part to emit light and a display panel to selectively transmit the light emitted by the light source part. The display panel comprises a first substrate comprising a light blocking layer and a second substrate opposing the first substrate. The light blocking layer comprises an opening through the light blocking layer, and the opening is arranged in a pixel area. The second substrate comprises a first transistor, a second transistor, a first driving electrode, a second driving electrode, and a shutter. The first transistor turns on in response to receiving a gate signal having a low level, and the second transistor is electrically connected to the first transistor and turns on in response to receiving a data signal having a low level. The first driving electrode is electrically connected to the first transistor, and the second driving electrode is electrically connected to the second transistor. The shutter transmits or blocks the light from the light source part by moving to the first driving electrode or the second driving electrode according to the relative levels of voltages applied to the first driving electrode and the second driving electrode.

An exemplary embodiment of the present invention further discloses a display panel that comprises a first substrate comprising a light blocking layer and a second substrate that opposes the first substrate. The light blocking layer comprises an opening arranged in a pixel area. The second substrate comprises a first switch, a second switch electrically connected to the first switch, a first driving electrode electrically connected to the first switch, a second driving electrode electrically connected to the second switch, and a shutter. The first switch turns on in response to a first signal having a first level, and the second switch turns on in response to a second signal having the first level. The shutter exposes or covers the opening by moving towards the first driving electrode or the second driving electrode in response to voltages applied to the first driving electrode and the second driving electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE ILLUSTRATED EMBODIMENTS

Figure 1:
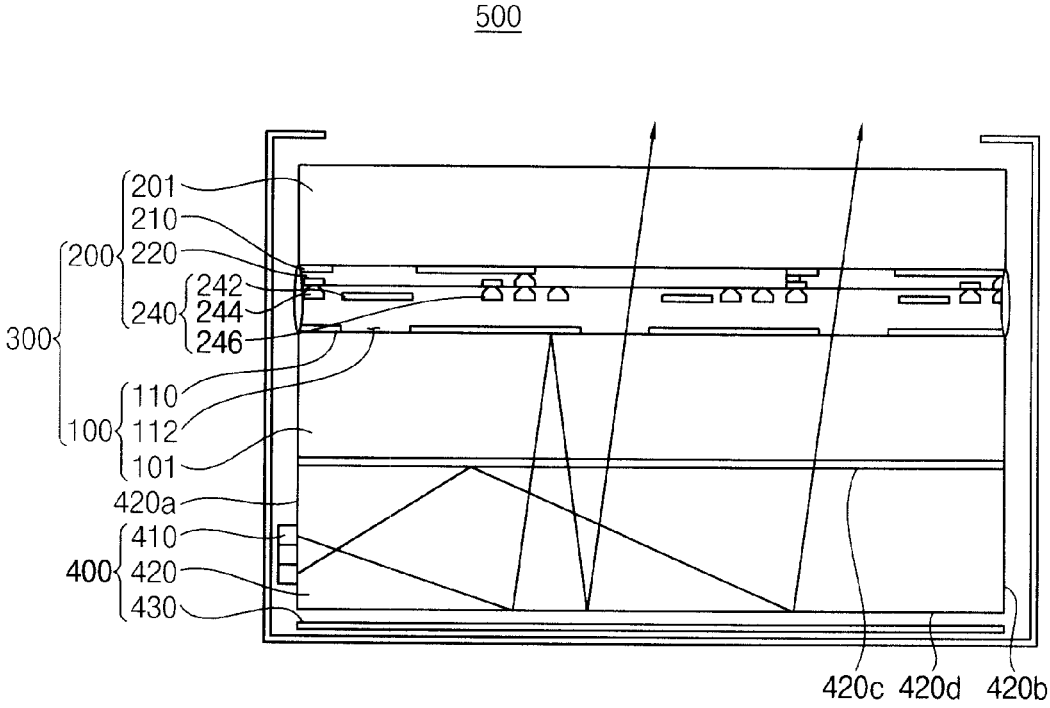
FIG. 1 is a cross-sectional view of a display apparatus according to an exemplary embodiment of the present invention.

The invention is described more fully hereinafter with reference to the accompanying drawings in which embodiments of the invention are shown. This invention may, however, be embodied in many different forms and should not be construed as limited to the embodiments set forth herein. Rather, these embodiments are provided so that this disclosure is thorough and will fully convey the scope of the invention to those skilled in the art. In the drawings, the size and relative sizes of layers and regions may be exaggerated for clarity. Like reference numerals in the drawings denote like elements.

FIG. 1 is a cross-sectional view of a display apparatus according to an exemplary embodiment of the present invention.

Referring to FIG. 1, the display apparatus 500 according to the present exemplary embodiment includes a display panel 300 and a backlight unit 400.

The display panel 300 includes a first substrate 100 and a second substrate 200 facing the first substrate 100.

The first substrate 100 includes a first base substrate 101 and a light blocking layer 110.

The first base substrate 101 may include a transparent insulating material.

The light blocking layer 110 is formed on the first base substrate 101. The light blocking layer 110 blocks or absorbs light incident through the second substrate 200 to prevent unnecessary reflected light from decreasing the contrast ratio of the display panel 300. The light blocking layer 110 includes an opening 112 formed through the light blocking layer 110, and the opening 112 is formed in a pixel area. The light emitted from the backlight unit 400 is provided to the second substrate 200 through the opening 112.

The second substrate 200 may include a second base substrate 201, a driving element 210, an insulating layer 220, and a shutter assembly 240.

The second base substrate 201 may include a transparent insulating material.

The driving element 210 is formed on the second base substrate 201. The driving element 210 may be electrically connected to a plurality of signal lines (not shown). The driving element 210 provides a signal for driving the shutter assembly 240 and may include a switching element (not shown) and a capacitor (not shown). The switching element may be a p-type metal-oxide semiconductor (PMOS) transistor and may be turned on in response to a gate signal Gm having a low level VOFF.

The insulating layer 220 is formed on the second base substrate 201 on which the driving element 210 and the signal lines are formed.

The shutter assembly 240 may be formed on the second base substrate 201 on which the insulating layer 220 is formed. The shutter assembly 240 includes a digital micro shutter (DMS) 242 and first and second electrode portions 244 and 246. The first and second electrode portions 244 and 246 are respectively disposed on both sides of the DMS 242 and move the DMS 242 laterally in the right and left directions. The right and left directions are substantially parallel with the second base substrate 201. The DMS 242 includes at least one opening portion (not shown). The DMS 242 exposes or covers the opening 112 of the light blocking layer 110. When the opening 112 of the light blocking layer 110 is exposed, the light emitted from the backlight unit 400 passes through the opening 112 and into the second base substrate 201. However, when the opening 112 is covered, the light emitted from the backlight unit 400 is blocked by a portion of the DMS 242 and does not pass into the second base substrate 201.

The display panel 300 may further include an insulating fluid disposed between the first and second substrates 100 and 200. For example, the insulating fluid may be oil.

The backlight unit 400 includes a light source part 410 and a light guide plate 420.

The light source part 410 emits light to the light guide plate 420. The light source part 410 may include a plurality of colored light sources emitting a first, a second, and a third color of light. For example, the colored light sources may include a red light emitting diode, a green light emitting diode, and a blue light emitting diode. The light source part 410 may divide a frame into first, second, and third sub-fields and may sequentially emit the first to third color lights during the first to third sub-fields, respectively.

The light guide plate 420 is disposed under the first substrate 100 of the display panel 300. The light guide plate 420 may have a plate shape and includes a light incident surface 420*a*, an opposite surface 420*b* opposite to the light incident surface 420*a*, an upper surface 420*c* connecting the light incident surface 420*a* with the opposite surface 420*b*, and a lower surface 420*d* opposite to the upper surface 420*c*. The light source part 410 is disposed on the light incident surface 420*a* of the light guide plate 420.

The backlight unit 400 may include a light reflecting sheet 430. The light reflecting sheet 430 is disposed under the lower surface 420*d* of the light guide plate 420. The light reflecting sheet 430 reflects light leaking from the lower surface 420*d*.

Figure 2:
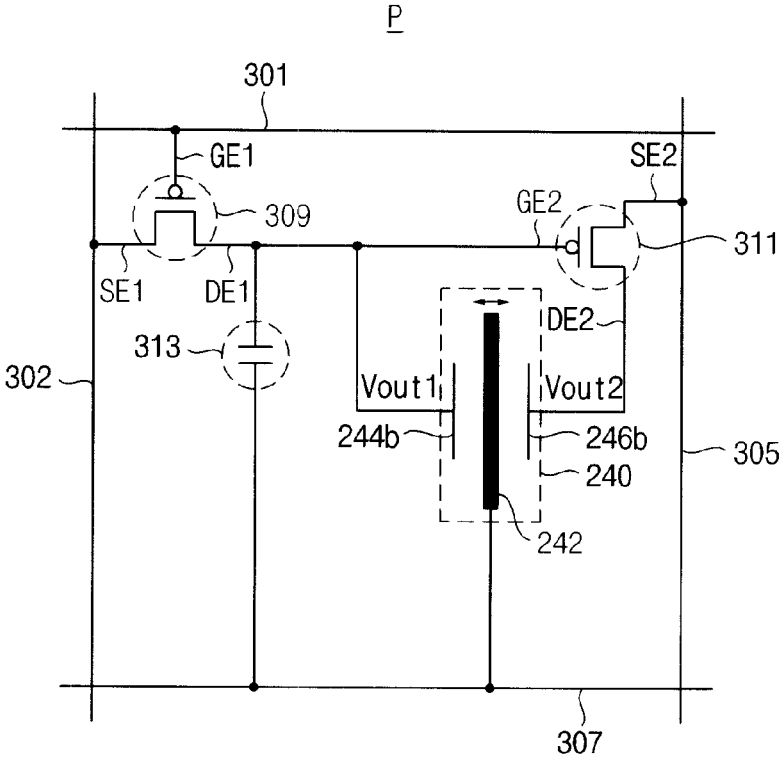
FIG. 2 is an equivalent circuit diagram of the display panel shown in FIG. 1.

FIG. 2 is an equivalent circuit diagram of a pixel of the display panel shown in FIG. 1.

Referring to FIG. 2, the display panel 300 includes a unit pixel P. The unit pixel P includes a gate line 301, a data line 302, a pulse signal line 305, a common voltage line 307, first and second PMOS transistors 309 and 311, a storage capacitor 313, and the shutter assembly 240.

The gate line 301 transmits a gate signal Gm to a gate electrode of the first PMOS transistor 309. The data line 302 transmits a data signal Dm to a source electrode of the first PMOS transistor 309.

The common voltage line 307 transmits a common voltage to the storage capacitor 313 and the DMS 242 of the shutter assembly 240.

The first PMOS transistor 309 includes a first control electrode (hereinafter, referred to as a first gate electrode) GE1, a first input electrode (hereinafter, referred to as a first source electrode) SE1, and a first output electrode (hereinafter, referred to as a first drain electrode) DE1. The first gate electrode GE1 is electrically connected to the gate line 301, and the first source electrode SE1 is electrically connected to the data line 302. The first drain electrode DE1 is electrically connected to a first driving electrode 244*b* of the shutter assembly 240.

The second PMOS transistor 311 includes a second control electrode (hereinafter, referred to as a second gate electrode) GE2, a second input electrode (hereinafter, referred to as a second source electrode) SE2, and a second output electrode (hereinafter, referred to as a second drain electrode) DE2. The second gate electrode GE2 is electrically connected to the first drain electrode DE1, and the second source electrode SE2 is electrically connected to the pulse signal line 305. The second drain electrode DE2 is electrically connected to a second driving electrode 246*b* of the shutter assembly 240.

The storage capacitor 313 includes a first electrode and a second electrode. The first electrode is electrically connected to the first drain electrode DE1, and the second electrode is electrically connected to the common voltage line 307. The storage capacitor 313 maintains a voltage applied to the first driving electrode 244*b* for one frame.

Figure 3:
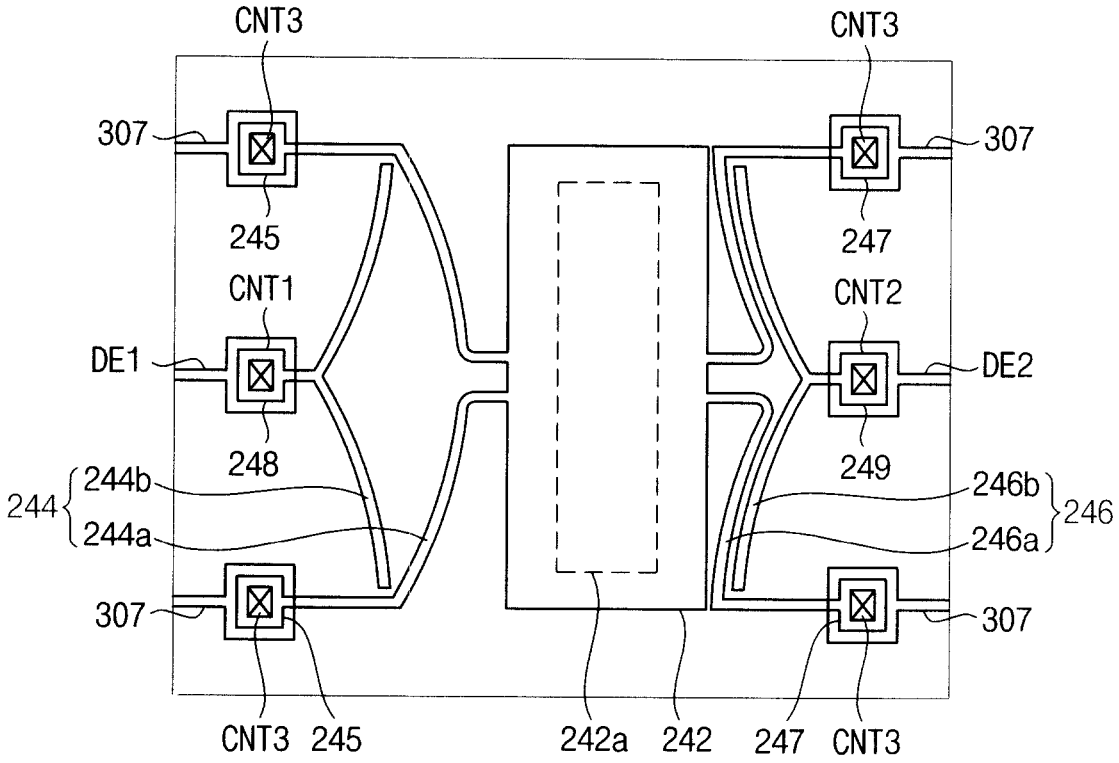
FIG. 3 is a plan view of the shutter assembly shown in FIG. 2.

FIG. 3 is a plan view of the shutter assembly shown in FIG. 2.

Referring to FIG. 2 and FIG. 3, the shutter assembly 240 may include the DMS 242 and the first and second electrode portions 244 and 246.

The first electrode portion 244 may include a first shutter electrode 244*a* and the first driving electrode 244*b*. The first shutter electrode 244*a* is connected to an end portion of the DMS 242 to mechanically connect the DMS 242 to two first shutter anchors 245 and supports the DMS 242 to be floated over the second substrate 200. The first driving electrode 244*b* is spaced apart from the first shutter electrode 244*a*. The first driving electrode 244*b* is mechanically connected to a first driving anchor 248 that is disposed between the first shutter anchors 245. The first driving electrode 244*b* is electrically connected to the first drain electrode DE1 through the first driving anchor 248 and a first contact portion CNT1.

The second electrode portion 246 may include a second shutter electrode 246*a* and the second driving electrode 246*b*.

The second shutter electrode 246*a* is connected to an end portion of the DMS 242 to mechanically connect the DMS 242 to two second shutter anchors 247 and supports the DMS 242 to be floated over the second substrate 200. The second driving electrode 246*b* is adjacent to the second shutter electrode 246*a* and mechanically connects to the second driving anchor 249 that is disposed between the second shutter anchors 247. The second driving electrode 246*b* is electrically connected to the second drain electrode DE2 through the second driving anchor 249 and a second contact portion CNT2. The first and second shutter electrodes 244*a* and 246*a* electrically connect to the common voltage line 307 through the first and second shutter anchors 245 and 247 and third contact portions CNT3. The DMS 242 is electrically connected to the common voltage line 307 through the first and second shutter electrodes 244*a* and 246*a* and receives the common voltage.

The DMS 242 moves horizontally between the first driving electrode 244*b* and the second driving electrode 246*b* according to the voltage applied to the first and second driving electrodes 244*b* and 246*b*. For example, when the level of the voltage applied to the first driving electrode 244*b* is greater than that of the voltage applied to the second driving electrode 246*b*, the DMS 242 moves to the first driving electrode 244*b*. When the level of the voltage applied to the second driving electrode 246*b* is greater than that of the voltage applied to the first driving electrode 244*b*, the DMS 242 moves to the second driving electrode 246*b*.

Figure 4:
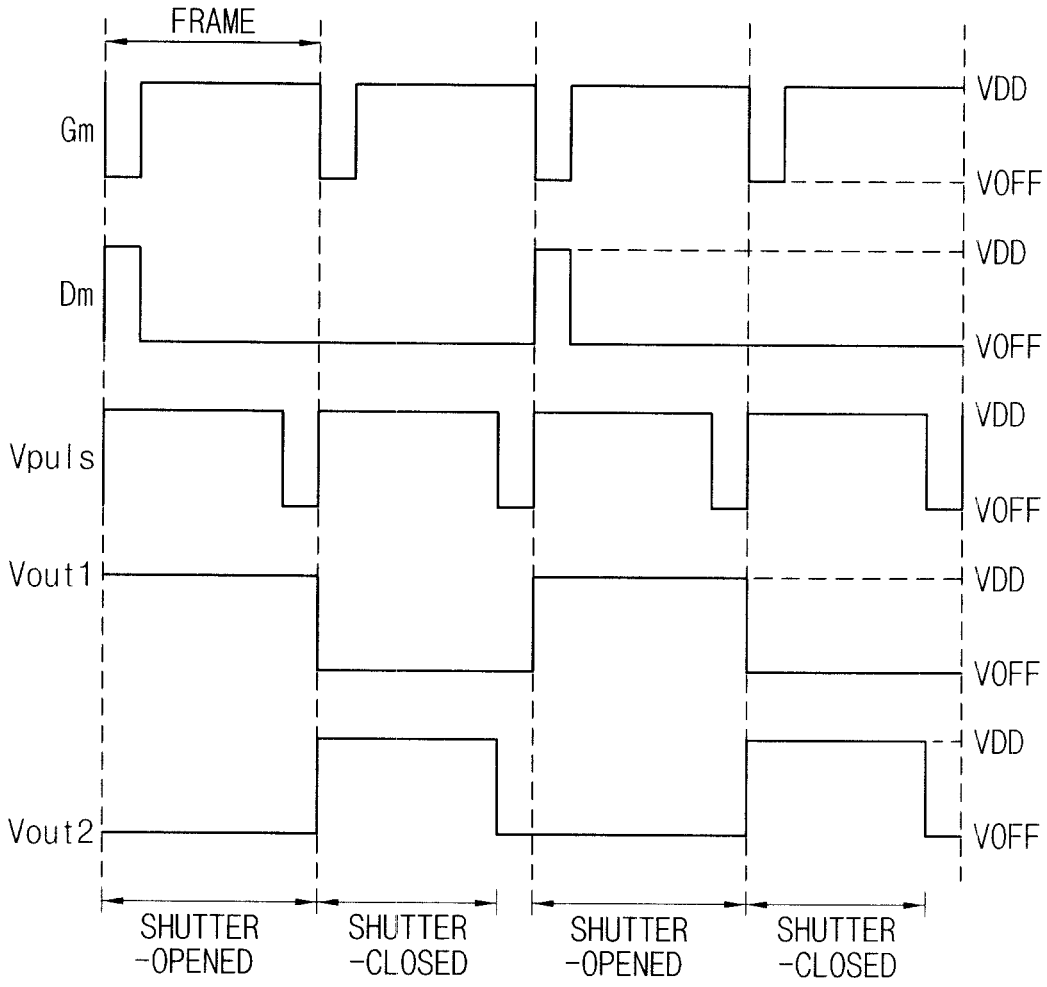
FIG. 4 shows waveform diagrams used in a method of driving the display panel shown in FIG. 2.

FIG. 4 shows waveform diagrams used in a method of driving the display panel shown in FIG. 2.

FIG. 4 shows the waveform diagrams for the gate signal Gm, the data signal Dm, a pulse signal Vpuls, a first output signal Vout1 of the first driving electrode 244*b* of the shutter assembly 240, and a second output signal Vout2 of the second driving electrode 246*b* of the shutter assembly 240.

Referring to FIG. 2 and FIG. 4, when the gate signal Gm has a low level VOFF and is applied to the gate line 301, the first PMOS transistor 309 is turned on. As a result of the first PMOS transistor being turned on, a data signal Dm having a high level VDD transmitted from the data line 302 is applied to the first driving electrode 244*b*. The storage capacitor 313 maintains the voltage applied to the first driving electrode 244*b* for one frame. When the data signal Dm having a high level VDD is applied to the second gate electrode GE2, the second PMOS transistor 311 is turned off. Accordingly, the DMS 242 moves to the first driving electrode 244*b*.

Since the DMS 242 is movable to the first driving electrode 244*b*, a shutter-open state or a shutter-closed state may be possible. In the shutter-open state, the opening 112 of the light blocking layer 110 is aligned with an opening portion 242*a* (shown in FIG. 3) of the DMS 242, and thus the light transmits through the opening portion 242*a* and to the second substrate 200 corresponding to the opening 112. In the shutter-closed state, the opening portion 242*a* of the DMS 242 is misaligned with the opening 112 of the light blocking layer 110 so that the light is blocked. Hereinafter, the shutter-open state is used when the DMS 242 moves to the first driving electrode 244*b*, and the shutter-closed state is used when the DMS 242 moves to the second driving electrode 246*b*.

In a second frame, although the gate signal Gm having a low level VOFF is applied to the gate line 301 and the first PMOS transistor 309 is turned on, the data signal Dm having a low level VOFF is applied to the data line 302 so that a voltage having a low level VOFF is applied to the first driving electrode 244*b*. When the data signal Dm having a low level VOFF is applied to the second gate electrode GE2 as a gate voltage, the second PMOS transistor 311 is turned on. As a result of the second PMOS transistor 311 being turned on, a voltage corresponding to a pulse signal Vpuls having a high level VDD is applied to the second driving electrode 246*b*. Accordingly, the DMS 242 moves to the second driving electrode 246*b* and is in the shutter-closed state. When the pulse signal Vpuls transitions from a high level VDD to a low level VOFF, the voltage applied to the second driving electrode 246*b* decreases from a voltage corresponding to the high level VDD to a voltage corresponding to the low level VOFF.

Therefore, according to the present exemplary embodiment, a circuit for driving the DMS 242 may be simplified so that the aperture ratio of the display may be enhanced.

Figure 5:
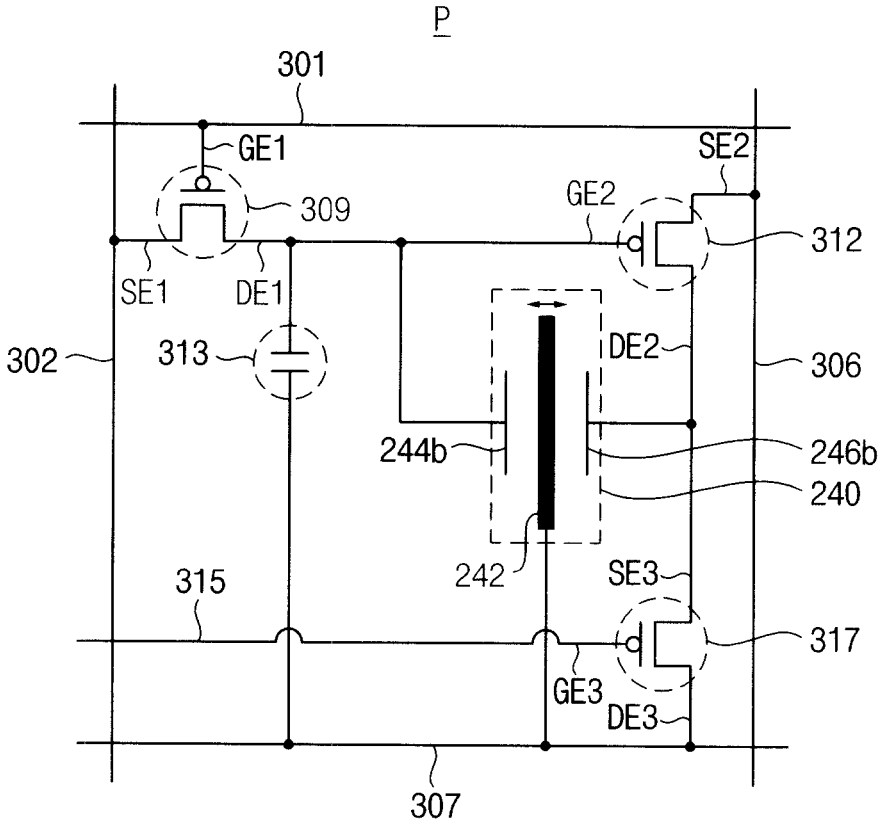
FIG. 5 is an equivalent circuit diagram of a display panel according to another exemplary embodiment of the present invention.

FIG. 5 is an equivalent circuit diagram of a display panel according to another exemplary embodiment of the present invention.

A display apparatus according to the present exemplary embodiment is substantially similar to the display apparatus 500 according to the previous exemplary embodiment shown in FIG. 1 except for the display panel. In addition, the unit pixel of the display panel according to the present exemplary embodiment is substantially similar to the unit pixel according to the previous exemplary embodiment in FIG. 1 except for a second PMOS transistor 312, a direct current voltage line 306, a control voltage line 315, and a third PMOS transistor 317. Thus, the same reference numerals will be used to refer to the same parts, and repetitive explanation is abbreviated or omitted.

Referring to FIG. 5, the unit pixel P of the display panel according the present exemplary embodiment may include the gate line 301, the data line 302, the direct current voltage line 306, the common voltage line 307, the control voltage line 315, the first, second and third PMOS transistors 309, 312 and 317, the shutter assembly 240, and the storage capacitor 313.

The control voltage line 315 transmits a control voltage Vctrl to the third PMOS transistor 317.

The first PMOS transistor 309 includes the first gate electrode GE1, the first source electrode SE1, and the first drain electrode DE1. The first gate electrode GE1 electrically connects to the gate line 301, and the first source electrode SE1 electrically connects to the data line 302. The first drain electrode DE1 electrically connects to the first electrode of the storage capacitor 313.

The second PMOS transistor 312 includes the second gate electrode GE2, the second source electrode SE2, and the second driving electrode DE2. The second gate electrode GE2 electrically connects to the first drain electrode DE1, and the second source electrode SE2 electrically connects to the direct current voltage line 306. The second drain electrode DE2 electrically connects to the second driving electrode 246*b* of the shutter assembly 240 and a third source electrode of the third PMOS transistor 317.

The third PMOS transistor 317 includes a third gate electrode GE3, the third source electrode SE3, and a third drain electrode DE3. The third gate electrode GE3 electrically connects to the control voltage line 315, and the third source electrode SE3 electrically connects to the second drain electrode DE2. The third drain electrode DE3 electrically connects to the common voltage line 307. The third PMOS transistor 317 turns on when the control voltage having a low level VOFF is received and decreases the level of the voltage applied to the second driving electrode 246*b* to the level of the common voltage.

The shutter assembly 240 is substantially similar to the shutter assembly 240 shown in FIG. 3. Thus, explanation concerning the above elements may not be repeated. The shutter assembly 240 includes the first and second driving electrodes 244*b* and 246*b* and the DMS 242. The first driving electrode 244*b* electrically connects to the first drain electrode DE1, and the second driving electrode 246*b* electrically connects to the second drain electrode DE2 and the third source electrode SE3. The DMS 242 moves to the first driving electrode 244*b* or to the second driving electrode 246*b* according to the level of the voltage applied to the first and second driving electrodes 244*b* and 246*b*.

Figure 6:
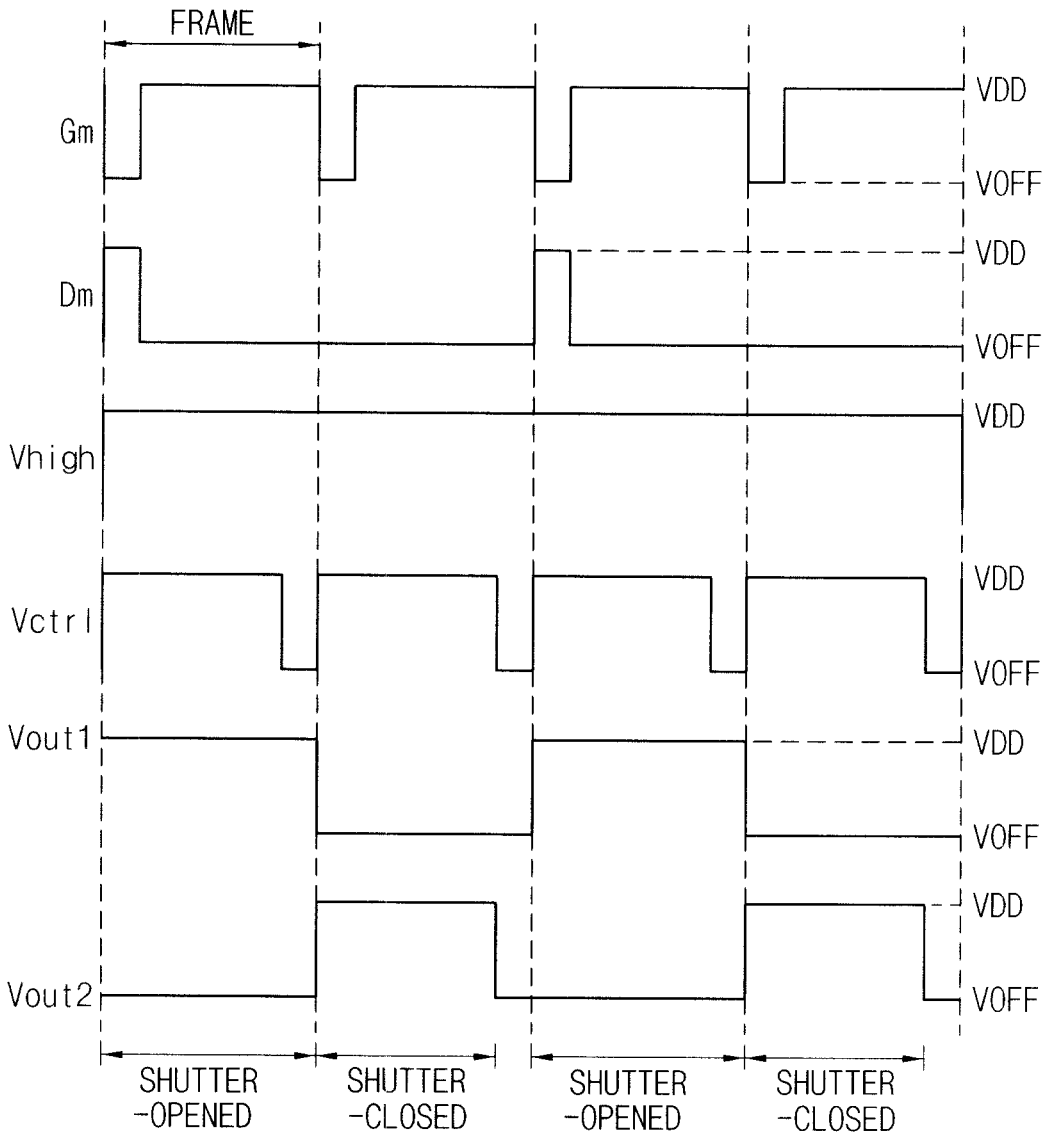
FIG. 6 shows waveform diagrams used in a method of driving the display panel shown in FIG. 5.

FIG. 6 shows waveform diagrams used in a method of driving the display panel shown in FIG. 5.

FIG. 6 shows waveforms for the gate signal Gm, the data signal Dm, a direct current voltage Vhigh, the control voltage Vctrl, the first output signal Vout1 of the first driving electrode 244*b* of the shutter assembly 240, and the second output signal Vout2 of the second driving electrode 246*b* of the shutter assembly 240.

Referring to FIG. 5 and FIG. 6, when the gate signal Gm having the low level VOFF is applied to the gate line 301, the first PMOS transistor 309 turns on. As a result of the first PMOS transistor 309 being turned on, the data signal Dm having a high level VDD transmitted from the data line 302 is applied to the first driving electrode 244*b* of the shutter assembly 240.

The storage capacitor 313 maintains the voltage applied to the first driving electrode 244*b* for one frame. Although the gate signal Gm transitions from a low level VOFF to a high level VDD, which turns off the first PMOS transistor 309, the data signal Dm having a high level VDD is applied to the second gate electrode GE2 by the storage capacitor 313. Consequently, the second PMOS transistor 312 maintains an off state. The DMS 242 moves to the first driving electrode 244*b* and is in the shutter-open state.

In the next frame, when the gate signal Gm having a low level VOFF is applied to the gate line 301 and the first PMOS transistor 309 turns on, a low level voltage VOFF is applied to the first driving electrode 244*b*. As the data signal Dm having a low level VOFF is applied to the second gate electrode GE2 and the second PMOS transistor 312 turns on, a direct current voltage Vhigh having a high level VDD is applied to the second driving electrode 246*b*. Accordingly, the DMS 242 moves to the second driving electrode 246*b* and is in the shutter-closed state. The storage capacitor 313 maintains the voltage applied to the first driving electrode 244*b* for the duration of one frame. However, the voltage applied to the second driving electrode 246*b* is not maintained for the duration of one frame. For example, when the control voltage Vctrl transitions from a high level VDD to a low level VOFF, the level of the voltage applied to the second driving electrode 246*b* is decreased to the level of the common voltage.

According to the present exemplary embodiment, the direct current voltage Vhigh is applied as an input signal of the second PMOS transistor 312 so that power consumption may be decreased compared to the previous exemplary embodiment in which the pulse signal Vpuls is applied as the input signal of to the second PMOS transistor 312.

Figure 7:
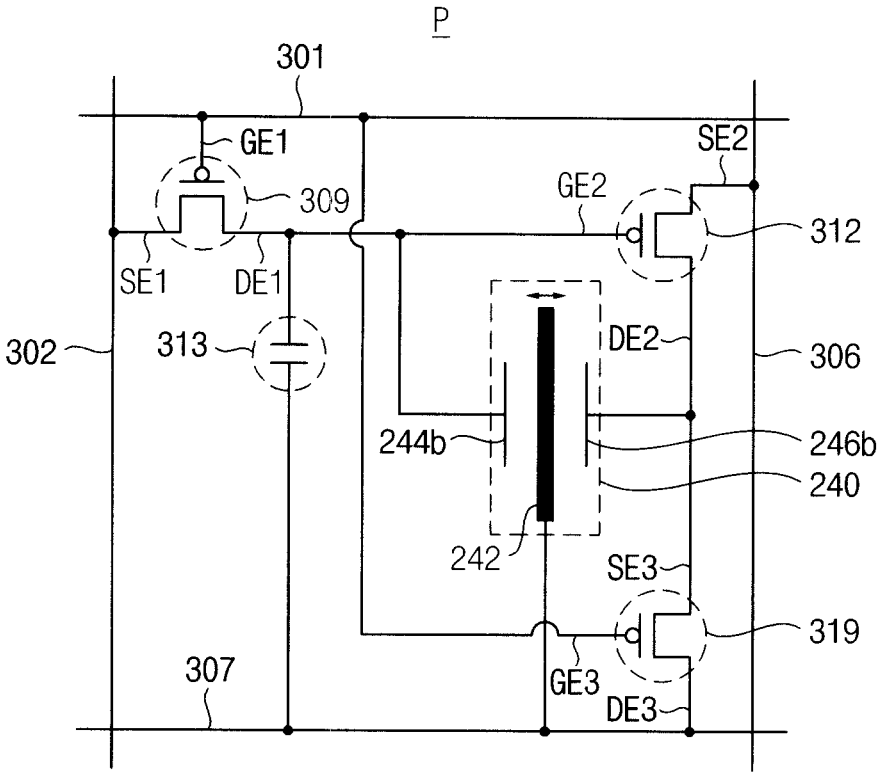
FIG. 7 is an equivalent circuit diagram of a display panel according to another exemplary embodiment of the present invention.

FIG. 7 is an equivalent circuit diagram of a display panel according to another exemplary embodiment of the present invention.

A display apparatus according to the present exemplary embodiment is substantially similar to the display apparatus 500 according to the exemplary embodiment shown in FIG. 1 except for the display panel. In addition, the unit pixel of the display panel according to the present exemplary embodiment is substantially similar to the unit pixel according to the exemplary embodiment shown in FIG. 5 except for a third PMOS transistor 319. Thus, the same reference numerals are used to refer to the same parts, and explanation concerning the above elements may be abbreviated or omitted.

Referring to FIG. 7, the unit pixel P according to the present exemplary embodiment may include the gate line 301, the data line 302, the direct current voltage line 306, the common voltage line 307, the first, second, and third PMOS transistors 309, 312, and 319, the storage capacitor 313, and the shutter assembly 240.

The third PMOS transistor 319 includes the third gate electrode GE3, the third source electrode SE3, and the third drain electrode DE3. The third gate electrode GE3 electrically connects to the gate line 301, and the third source electrode SE3 electrically connects to the second drain electrode DE2. The third drain electrode DE3 electrically connects to the common voltage line 307. The third PMOS transistor 319 turns on when the gate signal Gm having a low level VOFF is received and decreases the level of the voltage applied to the second driving electrode 246*b* to the level of the common voltage.

The shutter assembly 240 is substantially similar to the shutter assembly 240 shown in FIG. 3 so explanation concerning the above elements is abbreviated or omitted. The shutter assembly 240 includes the first and second driving electrodes 244*b* and 246*b* and the DMS 242. The first driving electrode 244*b* electrically connects to the first drain electrode DE1, and the second driving electrode 246*b* electrically connects to the second drain electrode DE2. The DMS 242 moves to the first driving electrode 244*b* or the second driving electrode or 246*b* according to the level of the voltage applied to the first and second driving electrodes 244*b* and 246*b*.

Figure 8:
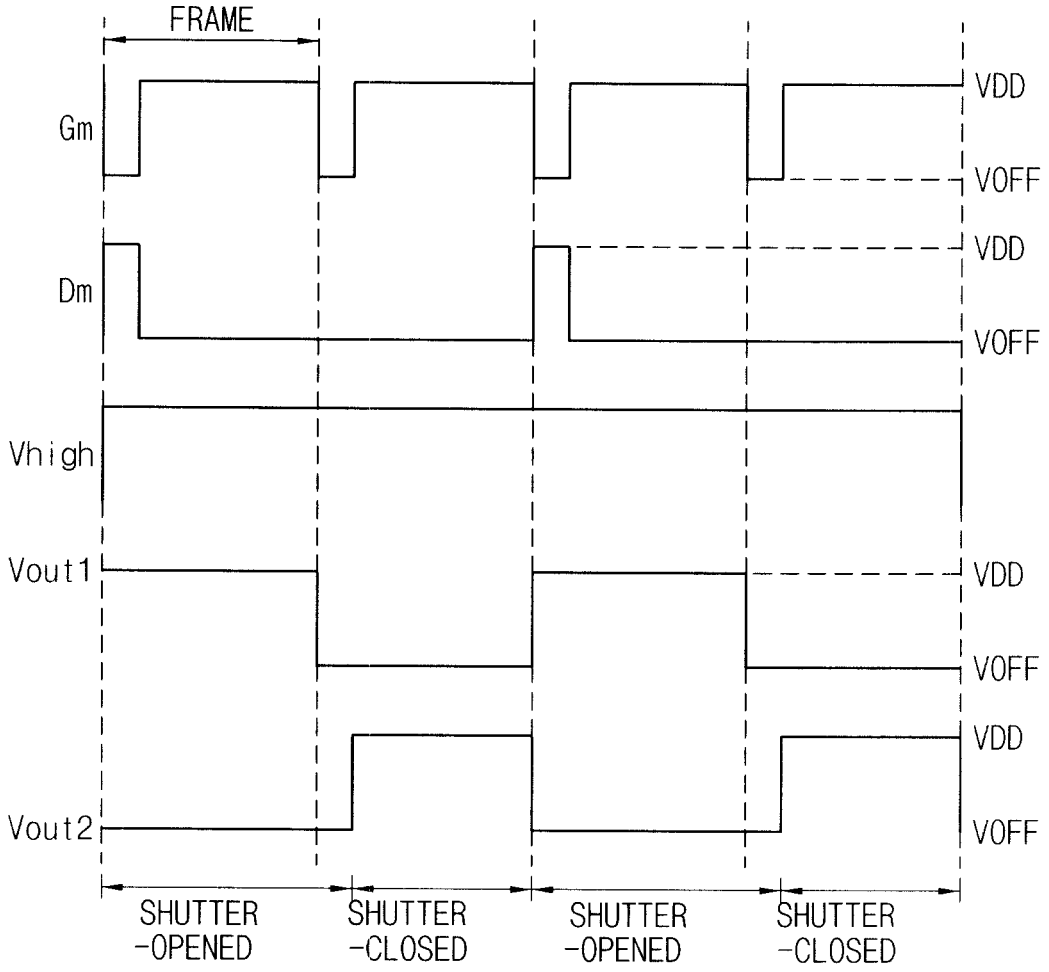
FIG. 8 shows waveform diagrams used in a method of driving the display panel shown in FIG. 7.

FIG. 8 shows waveform diagrams used in a method of driving the display panel shown in FIG. 7.

FIG. 8 shows waveforms for the gate signal Gm, the data signal Dm, the direct current voltage Vhigh, the first output signal Vout1 of the first driving electrode 244*b*, and the second output signal Vout2 of the second driving electrode 246*b* of the shutter assembly 240.

Referring to FIG. 7 and FIG. 8, when the gate signal Gm having a low level VOFF is applied to the gate line 301, the first PMOS transistor 309 turns on. Accordingly, the data signal Dm having a high level VDD transmitted from the data line 302 is applied to the first driving electrode 244*b* of the shutter assembly 240.

The storage capacitor 313 maintains the voltage applied to the first driving electrode 244*b* for one frame. Although the gate signal Gm transitions from a low level VOFF to a high level VDD, which turns off the first PMOS transistor 309, the data signal Dm having a high level VDD is applied to the second gate electrode GE2, and thus the second PMOS transistor 312 is turned off. As a result, the DMS 242 moves to the first driving electrode 244*b*, assuming the shutter-open state.

In the following frame, when the gate signal Gm having a low level VOFF is applied to the gate line 301 and the first PMOS transistor 309 turns on, the data signal Dm having a low level VOFF transmitted from the data line 302 is applied to the first driving electrode 244*b*. As the data signal Dm having a low level VOFF is applied to the second gate electrode GE2 and the second PMOS transistor 312 turns on, the direct current voltage Vhigh having a high level VDD is applied to the second driving electrode 246*b*. However, as the third PMOS transistor 319 turns on in response to the gate signal Gm having a low level VOFF, the direct current voltage Vhigh having a high level VDD applied to the second driving electrode 246*b* decreases to the level of the common voltage transmitted through the third PMOS transistor 319 from the common voltage line 307. Accordingly, when the gate signal Gm having a low level VOFF and the data signal Dm having a low level VOFF are sequentially applied, the DMS 242 may be positioned in an initial state at an intermediate position between the first and the second driving electrodes 244*b* and 246*b* before moving to the first driving electrode 244*b* or the second driving electrode 246*b*.

According the present exemplary embodiment, the direct current voltage Vhigh is applied as an input signal of the second PMOS transistor 312 so that power consumption may be decreased compared to a previous exemplary embodiment in which the pulse signal Vpuls is applied as the input signal of the second PMOS transistor 312. In addition, the third gate electrode GE3 is connected to the gate line 301 without additional connecting lines, and thus the number of signal lines may be decreased. Accordingly, the aperture ratio according to the present exemplary embodiment may be increased compared to the previous exemplary embodiment in which the control voltage line 315 is further included as shown in FIG. 5.

According to the present invention, the circuit for driving the unit pixel of the display panel may be configured using PMOS transistors. Accordingly, the number of the signal lines and the number of the transistors may be decreased, and thus production levels and the aperture ratio of the display apparatus may be enhanced. In addition, a design and a process for configuring the circuit may be simplified compared to those using a MOS transistor.

Although circuits for driving the unit pixel of the display panel are shown as being configured using PMOS transistors according to the exemplary embodiments described above, as a skilled artisan would recognize, NMOS transistors may alternatively be used.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A display panel, comprising:

a first substrate comprising a light blocking layer, the light blocking layer comprising an opening through the light blocking layer, the opening being arranged in a pixel area; and a second substrate opposing the first substrate and comprising:

a first transistor, a second transistor, a first driving electrode, a second driving electrode, and a shutter, wherein the first transistor is configured to apply a data signal at a high level to the first driving electrode and the second transistor in response to being turned on by a gate signal at a low level, wherein the second transistor is configured to apply a pulse signal at a high level to the second driving electrode in response to the data signal being at a low level, wherein the shutter is configured to expose or cover the opening in response to being moved to the first driving electrode or the second driving electrode according to the relative levels of voltage respectively applied to the first driving electrode and the second driving electrode, and wherein the shutter is configured to move to the first driving electrode when the data signal having the high level is applied to the first driving electrode and the shutter is configured to move to the second driving electrode when the pulse signal having the high level is applied to the second driving electrode.

2. The display panel of claim 1, wherein the second substrate further comprises a storage capacitor electrically connected to the first transistor.

3. The display panel of claim 2, wherein:
the second substrate further comprises:
a data line to transmit the data signal to the first transistor, and
a gate line to transmit the gate signal to the first transistor;
a first gate electrode of the first transistor is electrically connected to the gate line; and
the first transistor further comprises:
a first input electrode electrically connected to the data line, and
a first output electrode electrically connected to the first driving electrode.

4. The display panel of claim 3, wherein:
the second substrate further comprises a pulse signal line to transmit the pulse signal to the second transistor;
a second gate electrode is electrically connected to the first output electrode; and
the second transistor further comprises:
a second input electrode electrically connected to the pulse signal line, and
a second output electrode electrically connected to the second driving electrode.

5. The display panel of claim 3, wherein the second substrate further comprises a direct current voltage line to transmit a direct current voltage to the second transistor, the second gate electrode is electrically connected to the first output electrode, and the second transistor further comprises a second input electrode electrically connected to the direct current voltage line and a second output electrode electrically connected to the second driving electrode.

6. The display panel of claim 5, wherein the second substrate further comprises a third transistor electrically connected to the second driving electrode to decrease the direct current voltage applied to the second driving electrode.

7. The display panel of claim 6, wherein the third transistor comprises:
a third gate electrode to receive a control voltage;
a third input electrode electrically connected to the second driving electrode; and
a third output electrode electrically connected to a common voltage line.

8. The display panel of claim 6, wherein the third transistor comprises:
a third gate electrode electrically connected to the gate line;
a third input electrode electrically connected to the second driving electrode; and
a third output electrode electrically connected to a common voltage line.

9. A method, comprising:
applying, via a first transistor, a data signal at a high level to a first driving electrode and a second transistor electrically connected to a second driving electrode, the first transistor being turned on in response to receiving a gate signal at a low level and the second transistor being turned off in response to receiving the data signal at the high level; and
applying, to the first transistor, the gate signal at a high level to turn off the first transistor,
wherein a shutter is moved to a first position between the first driving electrode and the second driving electrode based on the first driving electrode receiving the data signal at the high level,
wherein the shutter is configured to either block or transmit light in the first position, and
wherein the shutter is configured to move to the first driving electrode when the data signal having the high level is applied to the first driving electrode and the shutter is configured to move to the second driving electrode when a signal having the high level is applied to the second driving electrode.

10. The method of claim 9, further comprising:
applying the data signal at a low level to the first transistor when the first transistor is turned on to convert a voltage applied to the first driving electrode from a high level to a low level;
applying a signal at a high level to the second driving electrode when the second transistor is turned on in response to the second transistor receiving the data signal at the low level,
wherein the shutter is moved to a second position between the second driving electrode and the first driving electrode based on the second driving electrode receiving the signal at the low level, and
wherein the shutter is configured to either transmit or block light in the second position.

11. The method of claim 10, further comprising:
applying a pulse signal at a high level to the second transistor,
wherein, in response to the second transistor receiving the data signal at the low level, the second transistor outputs the pulse signal as the signal applied to the second driving electrode.

12. The method of claim 10, wherein, in response to the data signal having a low level, the second transistor receives a direct current voltage having a high level as an input signal and outputs the direct current voltage as the signal applied to the second driving electrode.

13. The method of claim 12, further comprising:
decreasing a voltage applied to the second driving electrode through the third transistor,
when the direct current voltage having a high level is applied to the second driving electrode and a third transistor electrically connected to the second driving electrode receives a control voltage having a low level.

14. A display apparatus, comprising:
a light source part to emit light; and
a display panel to selectively transmit the light emitted by the light source part, the display panel comprising:
a first substrate comprising a light blocking layer, the light blocking layer comprising an opening through the light blocking layer, the opening being arranged in a pixel area; and
a second substrate opposing the first substrate and comprising:
a first transistor,
a second transistor,
a first driving electrode,
a second driving electrode, and
a shutter,
wherein the first transistor is configured to apply a data signal at a high level to the first driving electrode and the second transistor in response to being turned on by a gate signal at a low level,
wherein the second transistor is configured to apply a pulse signal at a high level to the second driving electrode in response to the data signal being at a low level,
wherein the shutter is configured to transmit or block the light from the light source part in response to being moved to the first driving electrode or the second driving electrode according to the relative levels of voltage respectively applied to the first driving electrode and the second driving electrode, and wherein the shutter is configured to move to the first driving electrode when the data signal having the high level is applied to the first driving electrode and the shutter is configured to move to the second driving electrode when the pulse signal having the high level is applied to the second driving electrode.

15. The display apparatus of claim 14, wherein:

the light source part comprises a plurality of light sources configured to emit a first light color, a second light color, and a third light color;

the light source part is configured to:

divide a frame into a first sub-field, a second sub-field, and a third sub field, and sequentially emit the first light color, the second light color, and the third light color during the first sub-field, the second sub-field, and the third sub-field, respectively.

16. The display apparatus of claim 14, wherein:

the second substrate further comprises:

a data line to transmit a data signal to the first transistor; and a gate line to transmit the gate signal to the first transistor;

a first gate electrode of the first transistor is electrically connected to the gate line; and the first transistor comprises:

a first input electrode electrically connected to the data line, and a first output electrode electrically connected to the first driving electrode.

17. The display apparatus of claim 16, wherein:

the second substrate further comprises a pulse signal line to transmit the pulse signal to the second transistor;

a second gate electrode is electrically connected to the first output electrode; and the second transistor further comprises:

a second input electrode electrically connected to the pulse signal line, and a second output electrode electrically connected to the second driving electrode.

18. The display apparatus of claim 16, wherein the second substrate further comprises a direct current voltage line to transmit a direct current voltage to the second transistor, the second gate is electrode electrically connected to the first output electrode, and the second transistor further comprises a second input electrode electrically connected to the direct current voltage line and a second output electrode electrically connected to the second driving electrode.

19. The display apparatus of claim 18, wherein the second substrate further comprises a third transistor electrically connected to the second driving electrode to decrease the direct current voltage applied to the second driving electrode.

20. The display apparatus of claim 19, wherein the third transistor comprises:

a third gate electrode to receive a control voltage;

a third input electrode electrically connected to the second driving electrode; and a third output electrode electrically connected to a common voltage line.

21. A display panel, comprising:

a first substrate comprising a light blocking layer, the light blocking layer comprising an opening arranged in a pixel area; and a second substrate opposing the first substrate and comprising:

a first switch, a second switch electrically connected to the first switch, a first driving electrode electrically connected to the first switch, a second driving electrode electrically connected to the second switch, and a shutter, wherein the first switch is configured to apply a first signal at a first level to the first driving electrode and the second transistor in response to being turned on by a second signal at a second level, wherein the second switch is configured to apply a third signal at the first level to the second driving electrode in response to the first signal being at the second level, wherein the shutter is configured to expose or cover the opening in response to being moved towards the first driving electrode or the second driving electrode in response to voltages respectively applied to the first driving electrode and the second driving electrode, and wherein the shutter is configured to move to the first driving electrode when the first signal having the first level is applied to the first driving electrode and the shutter is configured to move to the second driving electrode when the third signal having the first level is applied to the second driving electrode.

22. The display panel of claim 21, wherein:

the second substrate further comprises:

a data line to transmit the first signal to the first switch, and a gate line to transmit the first second to the first switch; and the first switch comprises:

a first control electrode electrically connected to the gate line;

a first input electrode electrically connected to the data line; and a first output electrode electrically connected to the first driving electrode.

23. The display panel of claim 22, wherein:

the second substrate further comprises a signal line to transmit the third signal to the second switch; and the second switch comprises:

a second control electrode electrically connected to the first output electrode;

a second input electrode electrically connected to the signal line; and a second output electrode electrically connected to the second driving electrode.

24. The display panel of claim 22, wherein the second substrate further comprises a voltage line to transmit a direct current voltage to the second switch, the second control electrode is electrically connected to the first output electrode, and the second switch further comprises a second input electrode electrically connected to the voltage line and a second output electrode electrically connected to the second driving electrode.

* * * * *